US005738436A

United States Patent [19]

Cummings et al.

[11] Patent Number: 5,738,436

[45] Date of Patent: Apr. 14, 1998

[54] MODULAR LIGHTING FIXTURE

[75] Inventors: John H. Cummings, Santa Ana; Alan I. Fujii, Huntington Beach, both of Calif.

[73] Assignee: M.G. Products, Inc., San Antonio, Tex.

[21] Appl. No.: 862,334

[22] Filed: May 23, 1997

Related U.S. Application Data

[63] Continuation-in-part of Ser. No. 714,940, Sep. 17, 1996, abandoned.

[51] Int. Cl.[6] ..... F21V 29/00

[52] U.S. Cl. ..... 362/294; 362/148; 362/226; 362/365; 362/373

[58] Field of Search ..... 439/418, 419, 439/602, 699.2; 362/226, 147, 148, 294, 296, 345, 364, 365, 373, 351

[56] References Cited

U.S. PATENT DOCUMENTS

| | | | |
|---|---|---|---|
| 2,692,374 | 10/1954 | Carson | 439/425 |
| 3,231,731 | 1/1966 | McDonald | 362/226 |
| 3,359,527 | 12/1967 | Hart | 439/602 |
| 4,048,491 | 9/1977 | Wessman | 362/364 |
| 4,450,510 | 5/1984 | Nilssen | 362/221 |
| 4,754,377 | 6/1988 | Wenman | 362/148 |
| 4,807,099 | 2/1989 | Zelin | 362/225 |
| 4,930,054 | 5/1990 | Krebs | 362/149 |
| 4,935,853 | 6/1990 | Collins | 362/272 |
| 5,045,984 | 9/1991 | Trowbridge et al. | 362/365 |
| 5,055,988 | 10/1991 | Cartwright | 362/294 |
| 5,136,489 | 8/1992 | Cheng et al. | 362/294 |
| 5,385,482 | 1/1995 | Rottner | 439/419 |
| 5,601,448 | 2/1997 | Poon | 439/419 |

FOREIGN PATENT DOCUMENTS

| | | | |
|---|---|---|---|
| 2091955 | 8/1982 | United Kingdom | 439/418 |
| 2109180 | 5/1983 | United Kingdom | 439/418 |

*Primary Examiner*—Alan Cariaso
*Attorney, Agent, or Firm*—Jenkens & Gilchrist, P.C.

[57] ABSTRACT

Piercing, heat sink, and reflector modules are detachably connected together to provide a lighting fixture adaptable to low voltage, line voltage, halogen, fluorescent, incandescent, and other lighting systems. In heat sensitive applications, such as insulated ceilings, a heat conductive basket sleeve is disposed around the heat sink and reflector modules, and the sleeve, heat sink module and reflector module are enclosed within a heat-sealing cover. Heat from the sleeve is conducted to a trim ring externally disposed on the lighting fixture. The lighting fixture permits direct connection to a continuous insulated cable without the requirement of a junction box connection, thereby facilitating installation of the fixture in either new or existing construction.

22 Claims, 14 Drawing Sheets

MODULAR LIGHTING FIXTURE

CROSS REFERENCE TO RELATED APPLICATION

This application is a continuation-in-part of application Ser. No. 08/714,940 filed Sep. 17, 1996, now abandoned.

BACKGROUND OF THE INVENTION

1. Technical Field

This invention relates generally to a modular lighting fixture, and more particularly to a modular lighting fixture particularly adapted for interior use as a recessed fixture.

2. History of Related Art

Heretofore, interior recessed lighting fixtures have typically been pre-assembled units having metallic-sheathed electrical cables extending from the fixture to a junction box attached to a side of the fixture or installed adjacent the fixture. The power supply for the fixture comes into the junction box whereat it is connected to the electrical leads extending from the fixture. If additional fixtures are to be electrically connected to the same circuit, the power distribution cables must also exit the junction box to the additional fixtures. Thus, it can be seen that the power supply cables must be routed to a junction box after the fixture is installed. In new construction, hanger bars, plaster frames, or other fixture supports must be installed prior to installing the fixture, and the drywall, plaster, or other wall and ceiling materials later applied. Cutouts, hopefully of the correct size and location, must be then be cut in the finished wall or ceiling to expose the preinstalled fixtures.

If additional lighting fixtures are to be installed in existing structures, such as during remodeling, it is often necessary to feed new wires through walls and ceilings to the specific desired location of the new fixture. Typically, junction boxes, if not previously assembled to the fixture, must be installed in the ceiling or other surface adjacent the desired location of the new fixture. This is often difficult to do because of limited access once a structure has been built and walls and ceilings enclosed.

Additionally, it is typically necessary to install hanger bars between joists and multi-directional plaster frames suspended between the hanger bars to support the fixture. Typical recessed lighting fixtures require an opening having a diameter of about 6 inches, which makes it difficult to install the captive hanger bars and multi-directional plaster frames in existing construction. In drop ceiling installations, it is necessary to provide support bars across the suspended panel in which the lighting fixture is to be installed. This requires that the fixture be installed on the panel prior to installing the panel in the supporting suspended framework. This requirement makes it difficult to install recessed fixtures in low clearance suspended ceilings.

Thus, it can be seen that with existing lighting fixtures it is necessary to wire the fixture to a power supply after installation of the fixture. The positioning of the electrical power supply cables is a particular problem in new construction, where only bare studs and joists exist to define rooms or other enclosed areas. Also, typical recessed lighting fixtures have heretofore been non-adjustable with respect to the direction of light projected from the fixture. For example, recessed ceiling light fixtures have been constructed so that they either project light vertically downwardly from the fixture or at a predetermined angle from a vertical line, e.g., about 30° to direct the light toward a wall surface. Thus, different fixtures or special trim are required for differently angled applications such as general down lighting, wall washing, spot lighting on a wall surface, accent lighting, or for sloped ceilings.

Also, recessed interior lighting fixtures have heretofore been constructed for a specific bulb and voltage application. Such applications include, but are not limited to, low voltage halogen, high voltage halogen, fluorescent, incandescent, high intensity discharge, pure sulfur, and other lighting arrangements. Generally, each different combination of voltage and bulb type have heretofore required a specifically designed fixture.

The present invention is directed to overcoming the problems set forth above. It is desirable to have a recessed interior lighting fixture that can be easily installed in either new construction, after the ceilings and walls have been finished, or in pre-existing structures. It is desirable to have such an interior recessed lighting fixture that does not require armored cable or other connection to an adjacently positioned junction box. It is also desirable to have such a recessed interior lighting fixture that can be readily adjusted to provide a desired angle of illumination. Furthermore, it is desirable to have such a recessed interior lighting fixture that can be easily modified to accommodate various voltage and bulb applications by simply changing a single module of the fixture.

SUMMARY OF THE INVENTION

In accordance with one aspect of the present invention, a lighting fixture comprises a piercing module, a heat sink module, and a reflector module, all of which are detachably connectable together to form a complete fixture. The piercing module has a channel extending across the module that is shaped to mate with the outer surface of a continuous insulated electrical wire, and a means for piercing the insulation of the continuous insulated wire and providing electrical communication between the wire and the piercing means. The heat sink module has a heat sink with a central bore extending through the heat sink, and an electrical bulb-receiving socket detachably disposed in the bore of the heat sink. The reflector module has a trim ring, a reflector support member, and a reflector that is detachably connected to the heat sink module. The reflector support member has a longitudinal axis concentrically disposed with respect to the trim ring, and the reflector is rotatably mountable in the reflector support member for movement about an axis transverse to the longitudinal axis of the reflector support member. The reflector support member also includes a means for maintaining the reflector at a predetermined position with respect to the transverse axis.

Other features of the lighting fixture embodying the present invention include the means for piercing the insulation of the continuous insulated wire comprising at least two pins, each respectively disposed at a predetermined position in the channel of the piercing module, a movable pressure plate adapted to mate with and at least partially surround a portion of the continuous insulated wire, and a means for forcibly moving the pressure plate in a direction toward the pins.

Still other features of the lighting fixture embodying the present invention include the reflector having a plurality of features defined in an outer surface, each of which are adapted to receive a detent member. The means for maintaining the reflector at a predetermined position with respect to the transverse axis includes a pair of detent members integrally formed with the reflector support member, each biased toward the reflector whereby the detent members forcibly engage selected ones of the surface features defined on the outer surface of the reflector when the reflector is mounted in the reflector support member.

Additional features of the lighting fixture embodying the present invention include a detachable cover surrounding the reflector and heat sink modules in spaced heat sealing relationship with the modules, and a sleeve formed of a heat conducting material disposed circumferentially around the reflector and heat sink modules at a position between the modules and the cover. The sleeve is in thermally conductive communication with the trim ring.

In accordance with another aspect of the present invention, a lighting fixture has an electrical power module and a lamp shield module. The electrical power module has a means for piercing the insulation of two wires of a cable and a second means for receiving an electric lamp and maintaining the lamp in a fixed position with respect to the power module. Separate first and second electrical circuits extend between the piercing means and the lamp receiving and maintaining means and provide respective separate electrical communication between the piercing means and the lamp receiving and maintaining means. At least one of the first and second electrical circuits comprises an elongated strip that is formed of an electrically conductive metallic material and has a portion of the piercing means integrally formed on a first end of the strip and a portion of the lamp receiving and maintaining means integrally formed on a second end of the strip. The lamp shield module has a first portion that is fixibly attached to the electrical power module, a second portion that is rotatably mounted on the first portion in a manner such that the first portion is movable with respect to the second portion about an axis that extends through the second portion, and a means for maintaining the second portion of the lamp shield module in fixed relationship with an opening in a predefined mounting surface.

Other features of the additional aspect of the lighting fixture embodying the present invention include at least one of the first and second electrical circuits having a thermal cutout member that opens the respective electrical circuit in response to exposure to a temperature higher than a desired value. Other features include the first electrical circuit being an elongated strip having a wire piercing pin integrally formed at a first end of the strip and a lamp pin receiving socket integrally formed at the second end. Other features, including the first portion of the lamp shield module of the lighting fixture having upper and lower annular walls, an interior surface extending between the upper and lower annular walls, a thermal radiant reflector spaced inwardly from the interior surface, an annular elastomeric gasket interposed between the thermal radiant reflector and the upper annular wall, and an annular O-ring interposed between the thermal radiant reflector and the lower annular wall, all of which cooperate to define a hermetically sealed chamber between a lamp inserted in the fixture and the external surfaces of the fixture.

BRIEF DESCRIPTION OF THE DRAWINGS

A more complete understanding of the structure and operation of the present invention may be had by reference to the following detailed description when taken in conjunction with the accompanying drawings, wherein.

DETAILED DESCRIPTION OF PRESENTLY PREFERRED EXEMPLARY EMBODIMENTS

Figure 1:
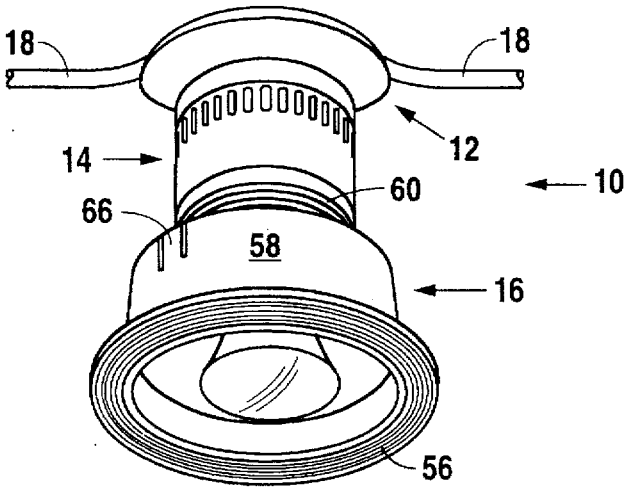
FIG. 1 is a three-dimensional view of a lighting fixture embodying the present invention.
Figure 2:
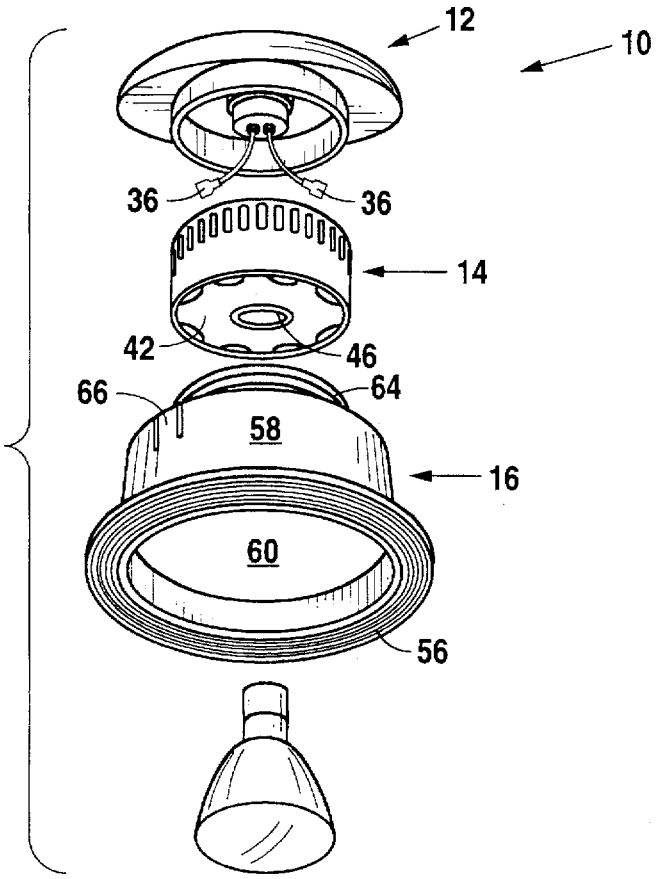
FIG. 2 is a three-dimensional exploded view of the lighting fixture embodying the present invention, as shown in FIG. 1.

In its basic form, a lighting fixture 10 embodying the present invention comprises three modular components. In the following described embodiments, the lighting fixture 10 is a recessed fixture adapted for use in either new or existing construction and, as best shown in FIG. 2, comprises a piercing module 12, a heat sink module 14, and a reflector module 16. As described below in greater detail, the lighting fixture 10 is adaptable to virtually any lighting system, i.e., low voltage, line voltage, halogen, fluorescent, incandescent, or other system by providing a heat sink module 14 adapted to the desired specific system. The piercing module 12 is capable of providing electrical connection with insulated, non-metallic sheathed, stranded wires within a preselected limited range of sizes, for example, 10 to 14 gage.

Figure 5:
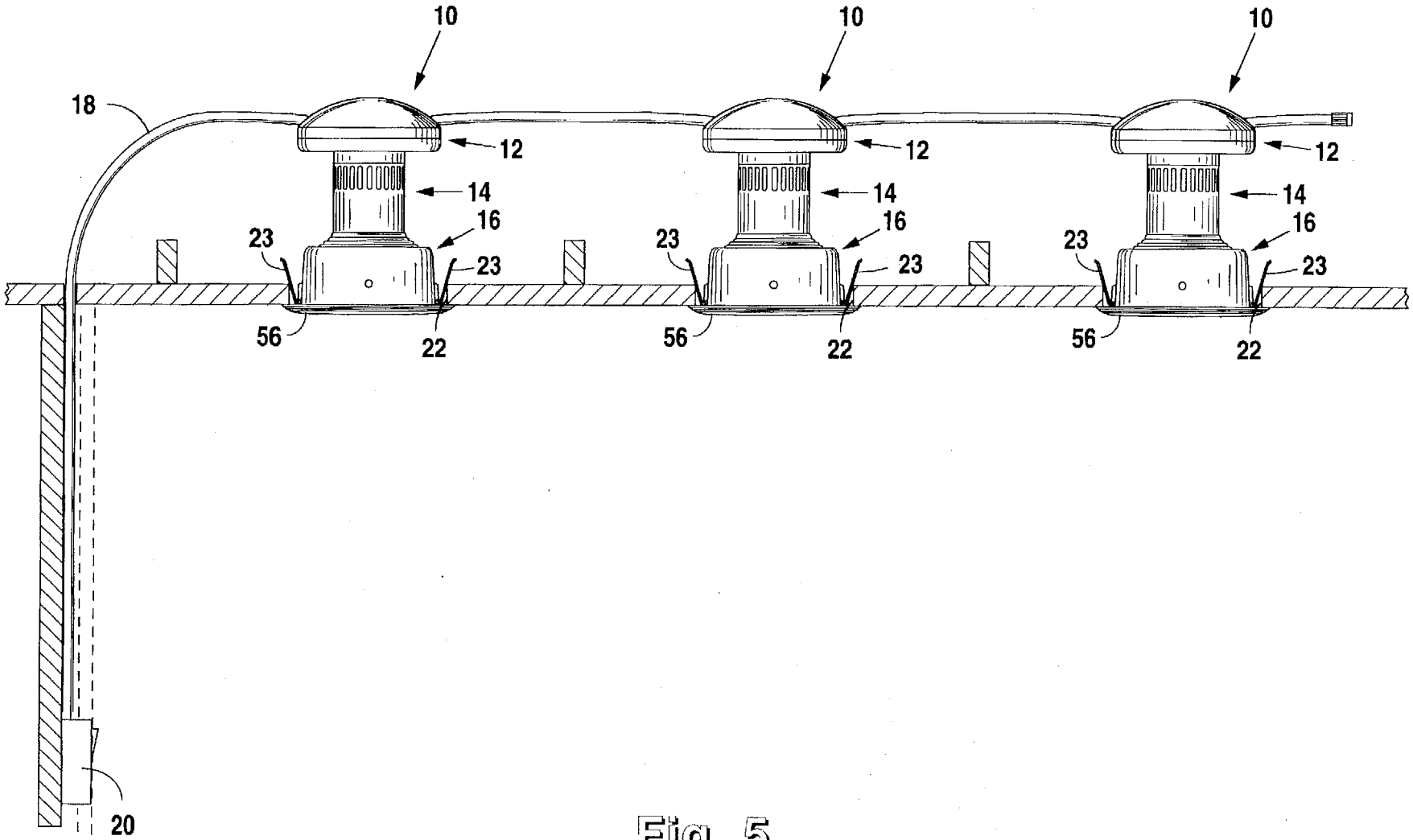
FIG. 5 is an elevational view of a lighting system comprising a plurality of lighting fixtures embodying the present invention.
Figure 6:
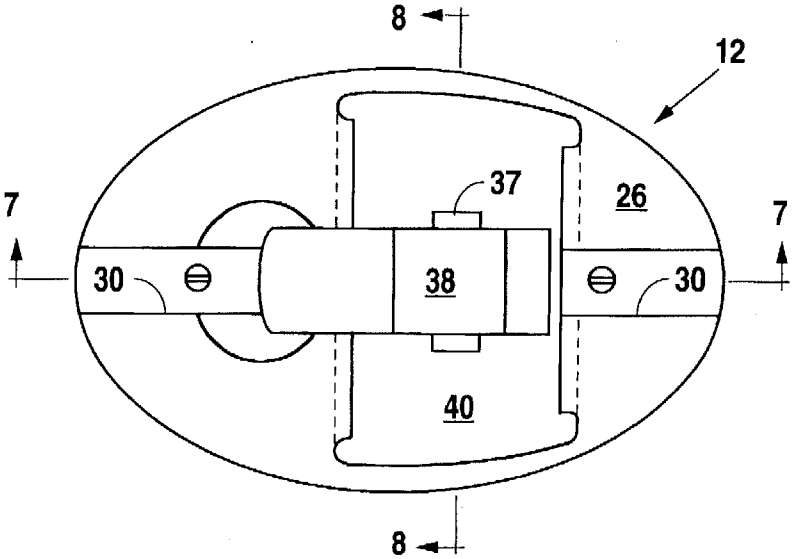
FIG. 6 is a top view of the piercing module of the lighting fixture embodying the present invention.
Figure 7:
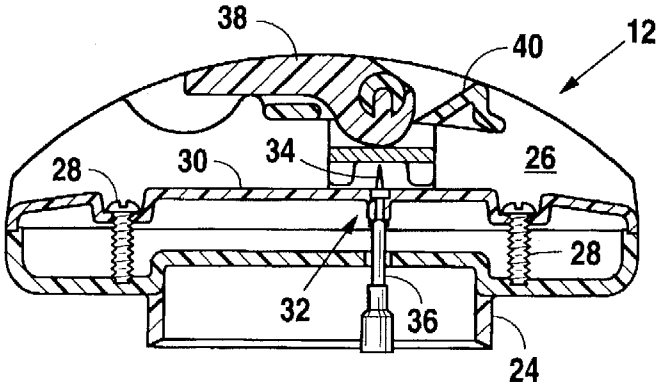
FIG. 7 is a cross-sectional view of the piercing module of the light fixture embodying the present invention, taken along the line 7—7 of FIG. 6
Figure 8:
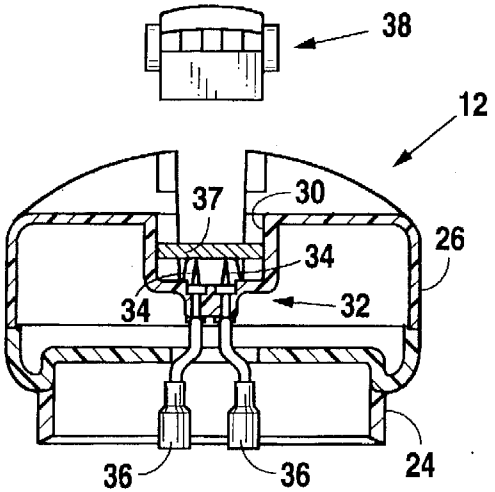
FIG. 8 is a cross-sectional view of the piercing module of the lighting fixture embodying the present invention, taken along the line 8—8 of FIG. 6.
Figure 9:
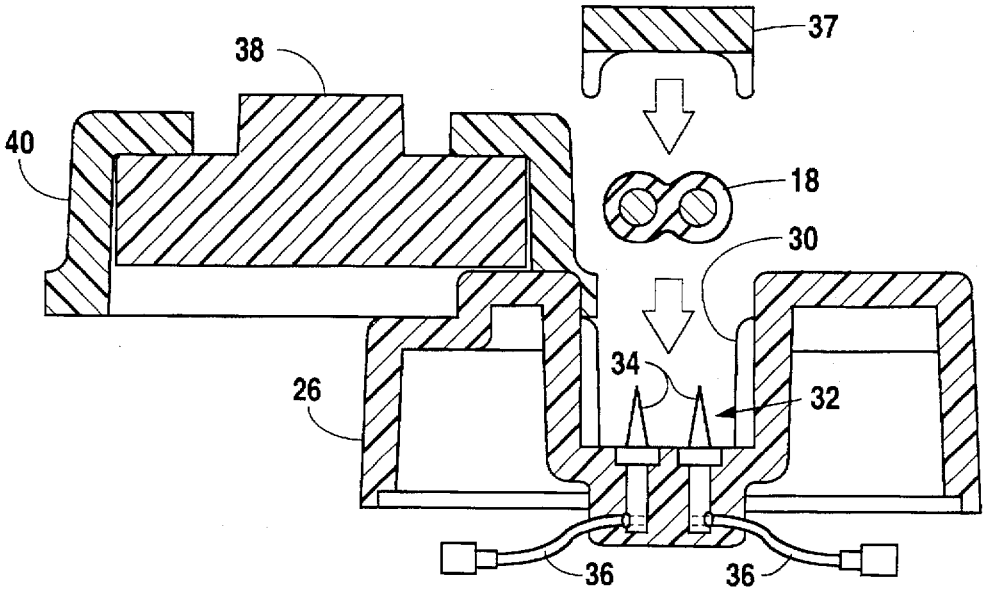
FIG. 9 is a cross-sectional view of the latching mechanism of the piercing module, showing the position of the respective components prior to insertion of an insulated cable in the piercing module.

Importantly, the piercing module 12 permits a single continuous insulated stranded cable 18 to enter and exit the fixture 10, as described below in greater detail, so that a plurality of the fixtures 10 may be arranged serially, as shown in FIG. 5, without interconnection with intervening junction boxes. In the illustrative embodiment, the electrical cable 18 is a 10-gage, 2-wire type NM sheathed cable rated at 600 volts, having about 105 strands per wire. Desirably, the outer sheath and inner wire insulation have a temperature rating of at least about 90° F. In existing installations, the cable 18 is conveniently connectable to an existing outlet box 20, either by connection to the wires conventionally provided in the outlet box 20 or by external plug attachment to the socket provided in the outlet box 20. On low voltage applications, the outlet 20 may also comprise a transformer to step down the line voltage to the desired low voltage requirements, e.g., 12 volts. Alternatively, the outlet 20 may comprise a conventional wall switch to control the operation of the fixtures 10. In the latter arrangement, the wire 18 may be connected directly to the switch 20. Also, if desired, the outlet 20 may also comprise a remotely controlled switch.

As illustrated in FIG. 5, a lighting system comprising the lighting fixtures 10 embodying the present invention is easily installed in either new or existing construction. In new construction, the cable 18 may be conveniently preconnected to a source 20 of electrical power and then arranged in a random pattern in the approximate area where the fixtures are to be subsequently installed. Precise prepositioning of the wire 18 is not required. After construction is finished, it is only necessary to saw or drill a hole 22 at the location where it is desired to place a fixture 10, extend one hand through the hole 22 and pull a short section of the cable 18 downwardly through the hole 22, insert the cable 18 in the piercing module 12, close the piercing module 12 thereby establishing electrical contact between the fixture 10 and the cable 18, and then simply inserting the fixture into the hole 22.

The fixture 10 also includes a means for retaining the fixture 10 in the opening 22. In the first illustrative embodiment, the retaining means includes a plurality of spring clips 23 attached to the reflector module 16. Other spring biased clips, such as the tabs 73 shown in FIGS. 14–16 that extend radially outwardly from the reflector module 16, may also be used. Thus, the entire fixture installation process is very simple and requires only a minimal amount of time, for example, less than three to five minutes to drill the hole, position and pierce the wire, and insert the fixture.

The piercing module 12 may comprise a conventional piercing arrangement such as that used on outdoor low-voltage lighting systems, or on connectors used to attach Christmas tree lights at selected positions along a wire. The outdoor low voltage system typically comprises a pair of blades, or pins, in the bottom of a holder, which pierce the insulation of a wire placed over the pins in response to screwing on a cap or wedging a closure member into place over the wire.

In the preferred embodiment of the present invention, the piercing module 12 comprises a lever-actuated locking cam arrangement, shown in detail in FIGS. 6–13, that is laterally removable to facilitate placement of the cable 18 into the piercing module 12. With specific reference to FIGS. 6–8, the piercing module 12 includes a base member 24 and an upper member 26 attached to the base member 24 by a pair of screws 28. The upper member 26 has a longitudinal channel 30 defined by walls having a length that extend completely across the piercing module 12 and are shaped to mate with the outer surface of the continuous insulated electrical cable 18 which, when placed in the channel 30, is preferably in tightly abutting contact with the bottom and sides of the channel 30.

The piercing module 12 also includes a means 32 for piercing the insulation of the continuous insulated cable 18 and providing electrical communication between cable 18 and the piercing means 32. More specifically, the piercing means 32 comprises a pin 34 for each of the wires in the electrical cable 18 which, in the illustrated embodiment, comprises two wires. The pins 34 are rigidly mounted in the upper member 26 and have a pair of electrical leads 36 attached to a lower portion of the pins 34. The electrical leads 36 extend through the base member 24 and have connectors attached to their respective outer ends. The electrical leads 36 are preferably attached to a respective one of the pins 34, such as by soldering, prior to inserting the pins 34 into the upper member 26. In the illustrative embodiment, the pins 34 are laterally aligned with each other, whereas in other embodiments the pins 34 may be staggered to provide increased longitudinal spacing between the pins.

The piercing means 32 also includes a pressure plate 37 that is adapted to mate with and partially surround a portion of the cable 18 and provide tightly abutting contact with the cable 18. In the illustrative embodiment, the pressure plate 37 has a square shape with the bottom contoured to mate with a predefined cable size, e.g., 10 ga, when oriented in a first direction, and with a differently sized cable, e.g., 12 ga, when rotated 90°.

The piercing means 32 also includes a means for forcibly moving the pressure plate 37 in a direction toward the pins 34. In the illustrated embodiment, the means of removing the pressure plate includes a lever-actuated cam 38 that is rotatably mounted on a cam support member 40. The cam support member 40 is slidably movable in a lateral direction with respect to the longitudinal channel 30 formed in the upper member 26 of the piercing module 12. However, when inserted into the upper member 26, the cam support member 40 is restrained from vertical displacement with respect to the upper member 26.

The insertion and piercing of the cable 18 in the piercing module 12 is illustrated in FIGS. 9–13. In the initial step, the cam support member 40 having the lever-actuated cam 38 rotatably mounted therein, is moved laterally to expose the longitudinal channel 30 formed in the upper member 26 of the piercing module 12. The cable 18 is then inserted into the channel and the pressure plate 37 is placed over the cable 18.

Figure 10A:
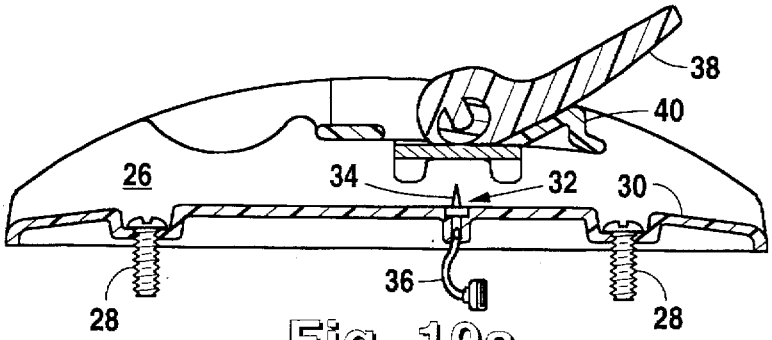
FIG. 10*a* is a longitudinal sectional view of the piercing module of the lighting fixture embodying the present invention, showing the latching mechanism position prior to closure.
Figure 10B:
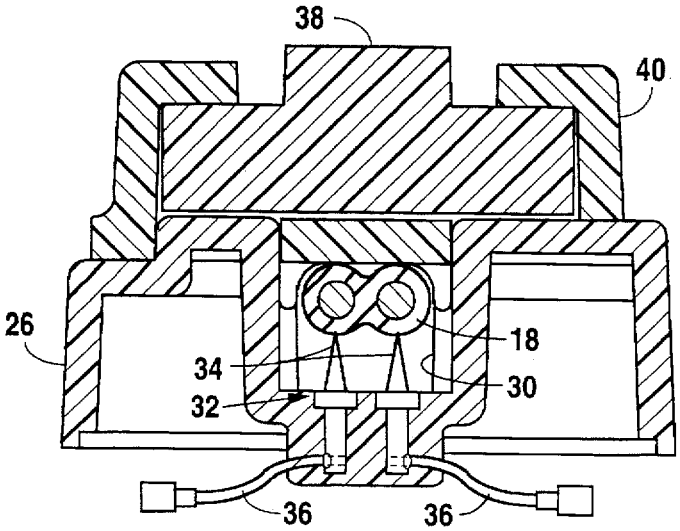
FIG. 10*b* is a cross-sectional view of the latching mechanism in the position shown in FIG. 10*a;*
Figure 11:
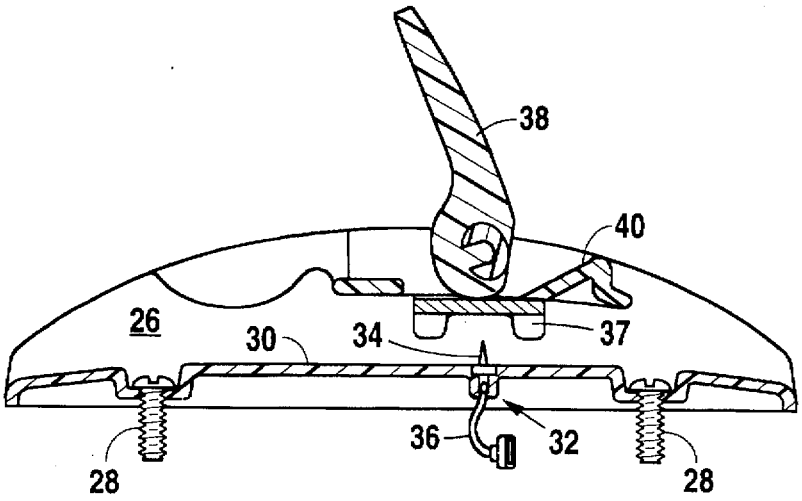
FIG. 11 is a longitudinal-sectional view of the piercing module of the lighting fixture embodying the present invention, showing the latching mechanism at a position intermediate to an open and closed position.
Figure 12A:
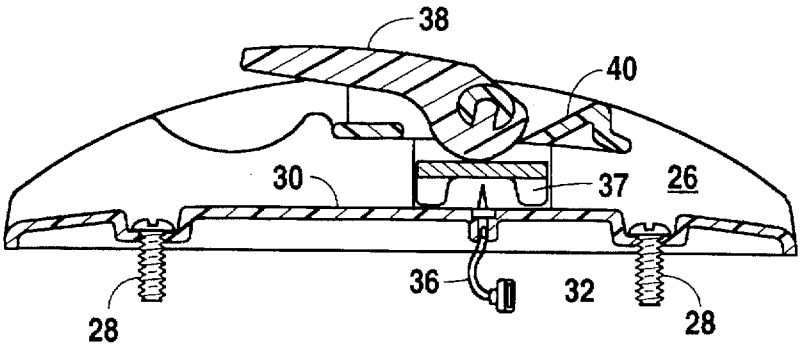
FIG. 12*a* is a longitudinal-sectional view of the piercing module of the lighting fixture embodying the present invention, showing the latching mechanism at its maximum compression position.
Figure 12B:
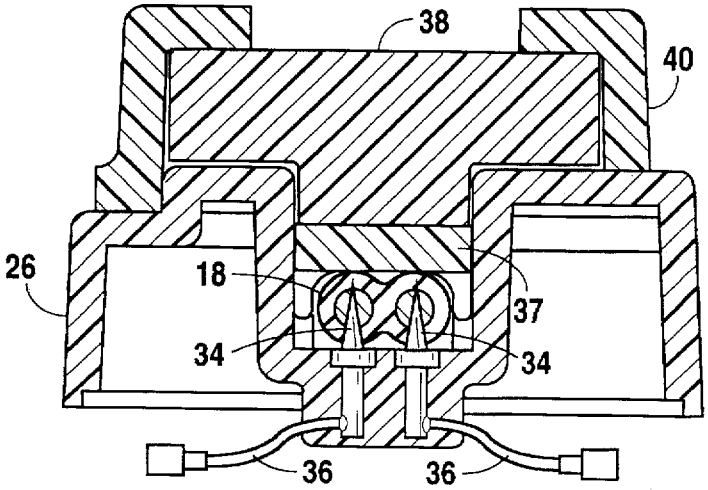
FIG. 12*b* is a cross-sectional view of the latching mechanism when disposed at the position shown in 12*a;*
Figure 13:
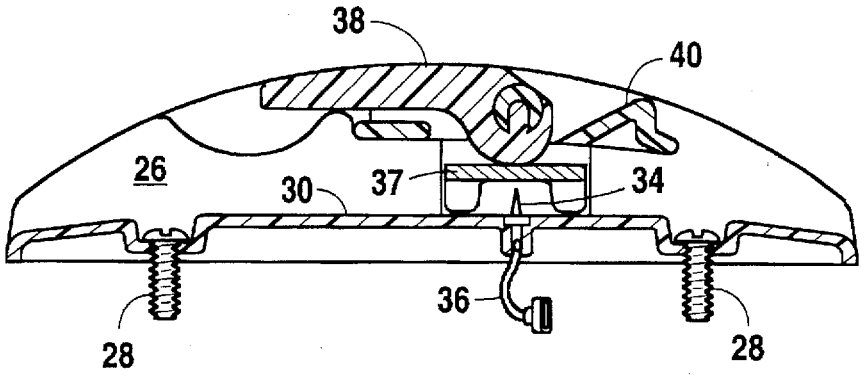
FIG. 13 is a longitudinal-sectional view of the piercing module component of the lighting fixture embodying the present invention showing the latching mechanism at a fully closed, over center, position.

After the cable 18 and pressure plate 37 are installed in the longitudinal channel 30, the lever-actuated cam 38 is rotated to the position shown in FIG. 10*a* to provide clearance for the cam 38 over the pressure plate 37. The cam support member 40 is then moved laterally to a position shown in 10*b* whereat the lever-actuated cam 38 is centered over the pressure plate 37. The lever-actuated cam 38 is then rotated in a counter-clockwise direction, as shown in FIG. 11, to move the pressure plate into forced contact with the cable 18. Rotation of the lever-actuated cam 38 is continued, as illustrated in FIG. 12*a*, and 12*b*, whereat the cable 18 is forced downwardly over the pointed ends of the pins 34 so that the pointed ends penetrate the insulation of the cable 18 and contact the stranded wires disposed within the cable 18. Rotation of the lever-actuated cam 38 is then continued until the cam 38 is at an over-center position and the lever end of the cam 38 is forcibly maintained at a position flush with the upper member 26, as shown in FIG. 13.

The heat sink module 14 is detachably connectable, either directly or indirectly, to the piercing module 12. The heat sink module 14 has a heat sink 42 having a central bore 44 formed therethrough that provides a mounting cavity for a bulb-receiving socket 46. In one embodiment, illustrated in FIGS. 17 and 18, the heat sink 42 is disposed within a single wall housing 48, preferably formed of a high temperature polyetherimide resin such as glass reinforced ULTEM® produced by General Electric. The heat sink 42 is retained in the housing 48 by one or more knurled screws 49 extending through the wall of the housing 48. In the illustrated embodiment, the housing 48 provides direct connection of the heat sink module 14 to the piercing module 12, either by screws extending from one member to the other or by a snap engagement, interference fit between the housing 48 and the base member 24 of the piercing module 12, as shown by way of example in FIG. 17..

In other embodiments, the heat sink 42 may be exposed directly to the surrounding environment, i.e., without a surrounding housing, in which arrangement the base member 24 of the piercing module 12 may be directly attached to the heat sink 42 via screws. In yet another arrangement, the housing 48 may comprise double cylindrical walls, one radially spaced from the other, to provide additional isolation of the heat sink 42 from the external surface of the lighting fixture 10. In still another embodiment, described below in more detail, the heat sink module 14 and the reflector module 16 are completely enclosed within an outer cover. In this arrangement, the heat sink module 14 is indirectly connected to the piercing module 12 via the cover enclosing the modules.

Figure 18:
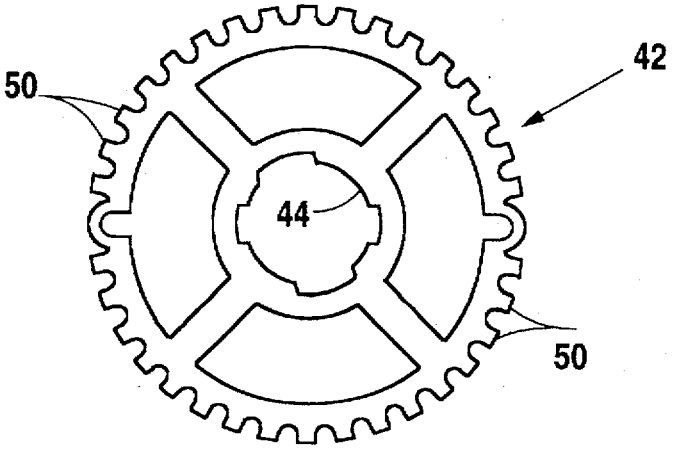
FIG. 18 is a top view of the heat sink shown in section in FIG. 17, adapted for use in the lighting fixture embodying the present invention.
Figure 19:
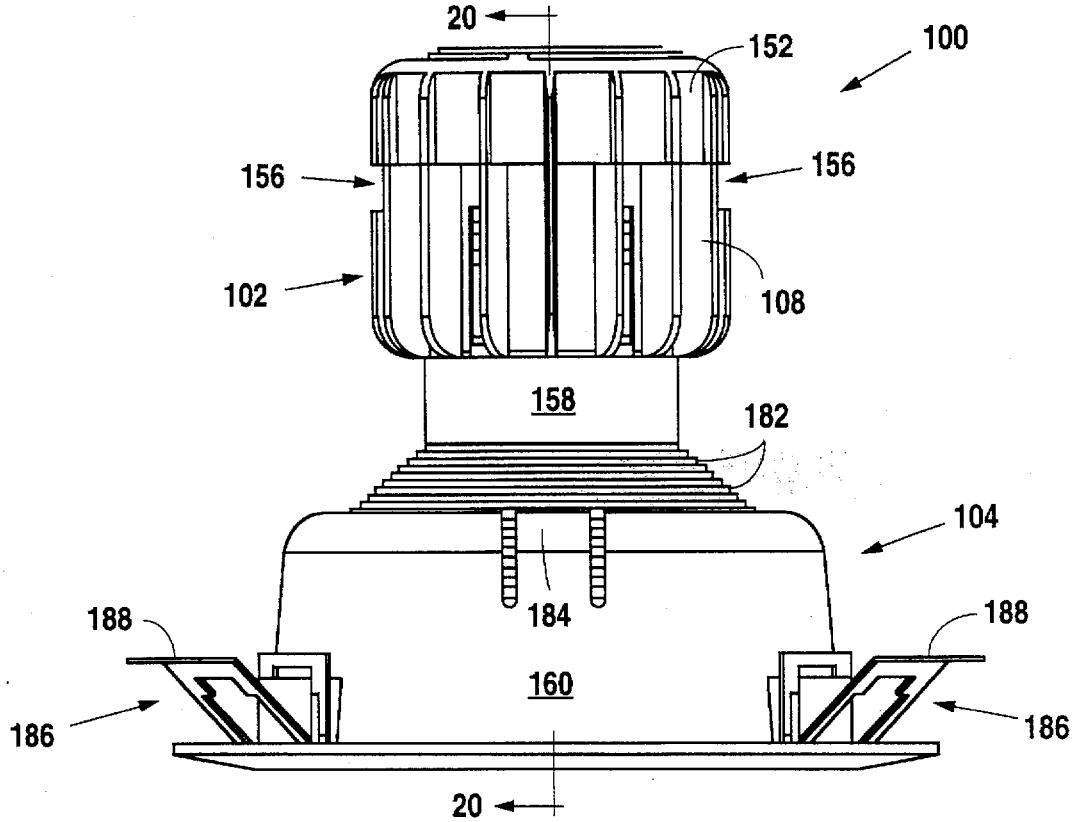
FIG. 19 is a plan view of an alternative embodiment of a lighting fixture embodying the present invention.

Preferably, the heat sink 42 is formed of a metallic material having high thermal conductivity, such as aluminum. To facilitate radiation of heat from the heat sink 42, the outer circumferential surface of the heat sink preferably is shaped to provide a plurality of fins 50 as shown in FIG. 18. The central bore 44 of the heat sink 42 is relieved to provide clearance for a socket hanger 52 which extends upwardly through the bore 44 and then extends laterally across the top of the heat sink 42 whereat it is secured to the heat sink via screws 54 that engage screw holes provided in a radially outer portion of the heat sink 42. Prior to assembly of the heat sink module 14 to the piercing module 12, electrical leads from the socket 46 are connected to the leads 36 extending from the pins 34, thereby providing electrical communication between the piercing pins 34 and the socket 46.

The reflector module 16 of the lighting fixture 10, embodying the present invention, includes a trim ring 56, a reflector support member 58, and a reflector 60 that is detachably connectable, either directly or indirectly, to the heat sink module 14. Alternatively, the heat sink housing 48 may be integrally formed with the reflector 60, and the heat sink module 14, comprising the heat sink 42 and socket 46, detachably mounted in the integrally formed housing 48. The reflector support member 58 is concentrically disposed with respect to the trim ring 56 about a longitudinal axis that is perpendicular to the mounting surface of the fixture 10. The reflector 60 is rotatably mounted in the reflector support member 58 by a pair of pins 62, one of which may be seen in FIGS. 3 and 4. In the illustrated embodiment, the pins 62 are integrally formed with the reflectors 60 and extend, by snap fit, into holes provided in the reflector support member 58. The reflector 60 is preferably spherically shaped and is capable of rotation, or tilting, within the reflector support member 58 to an angle $\alpha$ from a line 59 perpendicular to the mounting surface. In the illustrated embodiment, the angle $\alpha$ has a range from 0° to about 35° in either direction from the perpendicular line. Thus, the reflector 60 has a total range of adjustability of about 70°.

Figure 3:
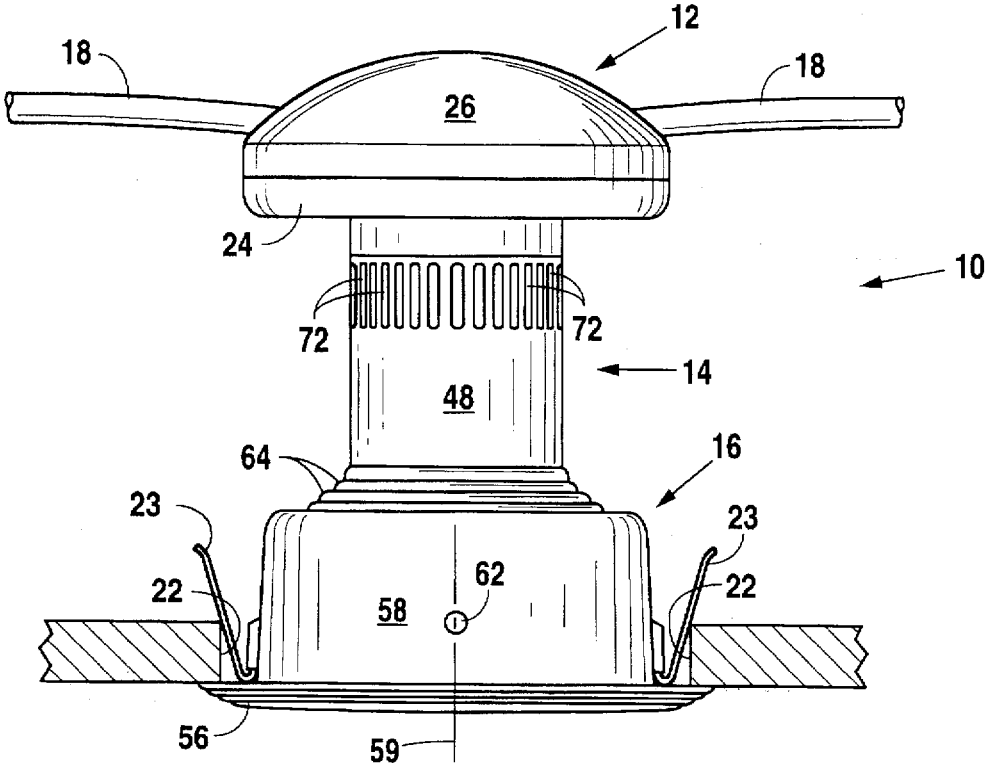
FIG. 3 is an elevational view of the lighting fixture embodying the present invention, as shown in FIG. 1, with the fixture installed in a ceiling and adjusted to direct illumination from the fixture in a vertically downward direction.
Figure 4:
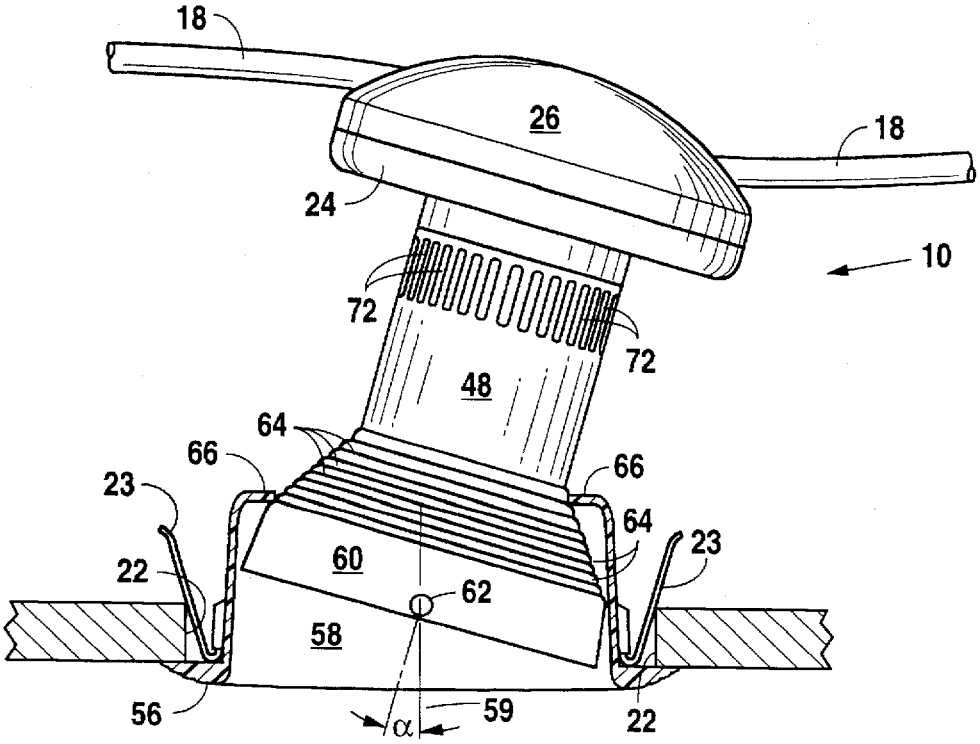
FIG. 4 is an elevational view of the lighting fixture embodying the present invention, as shown in FIG. 1 except for showing the reflector support member in section, wherein the lighting fixture is shown in a tilted position to direct illumination in a direction angled from a vertical direction.

The reflector module 16 also includes a means for maintaining the reflector 60 at a desired angle $\alpha$ with respect to the perpendicular line 59. As best shown in FIGS. 3 and 4, the outer surface of the reflector 60 is shaped to provide a series of reaction surfaces adapted to receive a detent member that is in biased contact with the surface. In the illustrated embodiment shown in FIGS. 1–4, the outer surface of the reflector 60 is defined by a series of stepped, progressively smaller diameter, concentric rings 64. Two detent members 66, integrally formed with the reflector support member 58, have an inwardly extending lip or finger that is shaped to engage one of the concentric rings 64 on the outer surface of the reflector 60. The length of the fingers on the detent members 66 are slightly longer than the free clearance distance between the inwardly extending end of the detent member 66 and the outer surface of the reflector 60. Thus, when engaged, detent members 66 are forced outwardly thereby creating a bias force bearing against the outer surface of the reflector. The created bias force is sufficient to maintain the reflector 60 at a respective angled position $\alpha$ with respect to the reflector support member 58, and still permit angular adjustment of the reflector, even after installation of the light fixture 10 in a ceiling or other panel.

In other arrangements, the means for maintaining the reflector 60 at a predetermined angled position may comprise a plurality of aligned recesses in the outer surface of the reflector 60, with the detent members comprising a small ball, pin, or other shape adapted to engage the recesses provided in the outer surface of the reflector 60.

Preferably, the reflector 60 is also formed of a high temperature plastic resin material, and, if desired, may be coated with a reflective material to direct heat, and light if the bulb does not have an integral reflector formed therein, downwardly from the fixture 10. Also, if the heat sink 42 is enclosed within a housing, it is desirable that the housing also be formed of a high temperature plastic material. Other less heat-sensitive components of the light fixture 10, such as the piercing module 12 and the reflector support member 58 may be formed of a lower temperature service-rated plastic material, for example a thermoplastic polyester resin such as VALOX®, also produced by GE Plastics. The trim ring 56 may be integrally formed with the reflector support member 58, or as shown in FIGS. 15 and 16, may be assembled to the reflector support member 58 by providing a snap engagement, interference fit between the two members.

Figure 14:
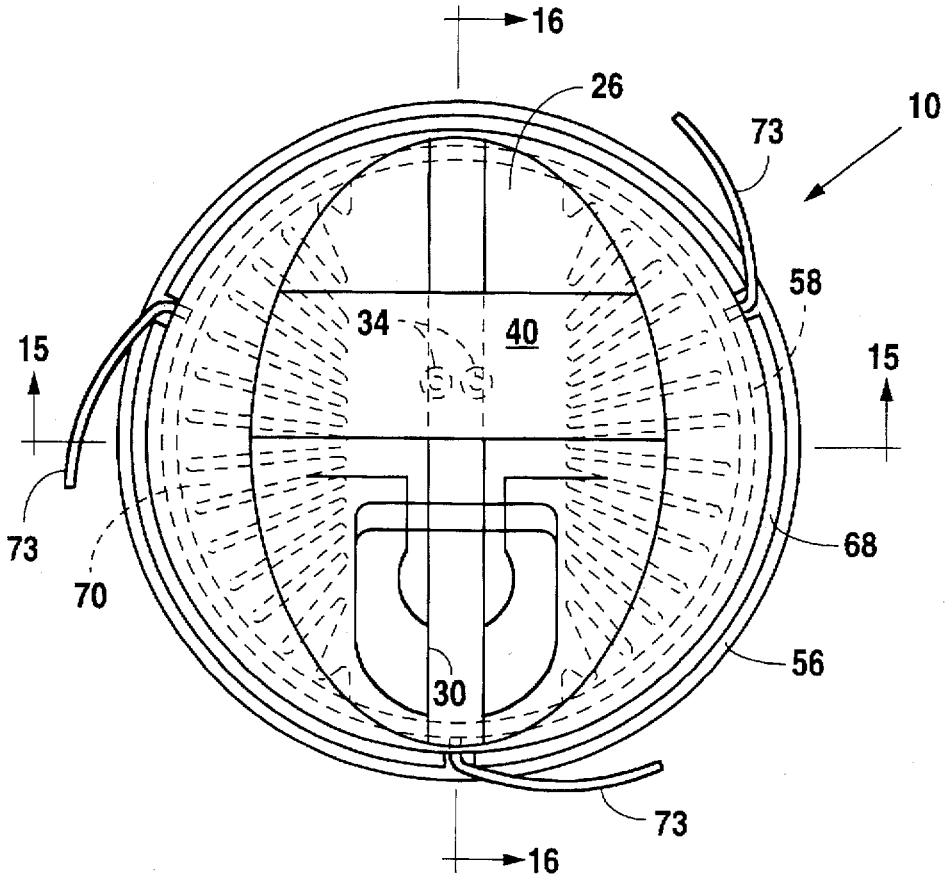
FIG. 14 is a top view of another embodiment of the lighting fixture embodying the present invention.
Figure 15:
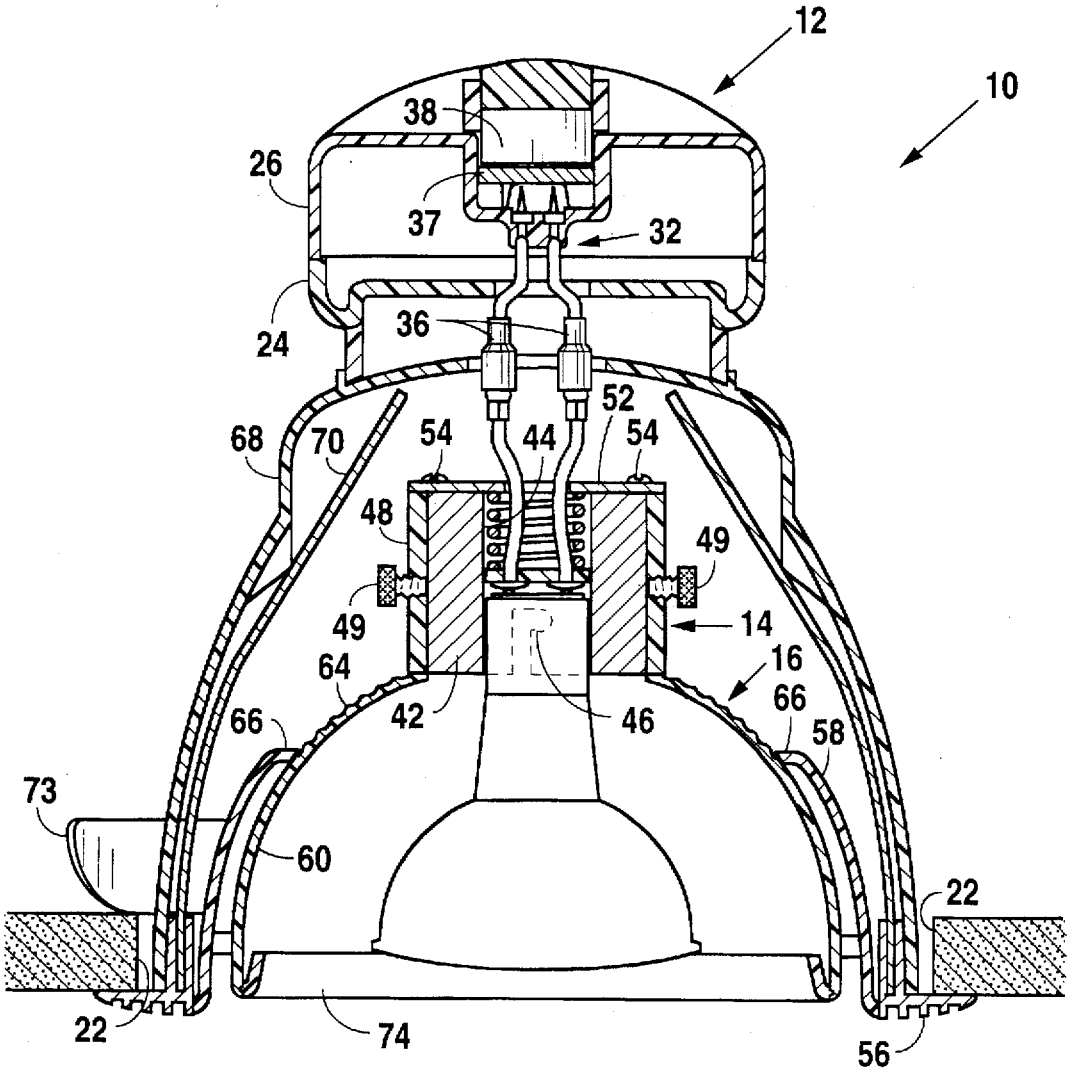
FIG. 15 is a cross-sectional view taken along the line 15—15 of FIG. 14.
Figure 16:
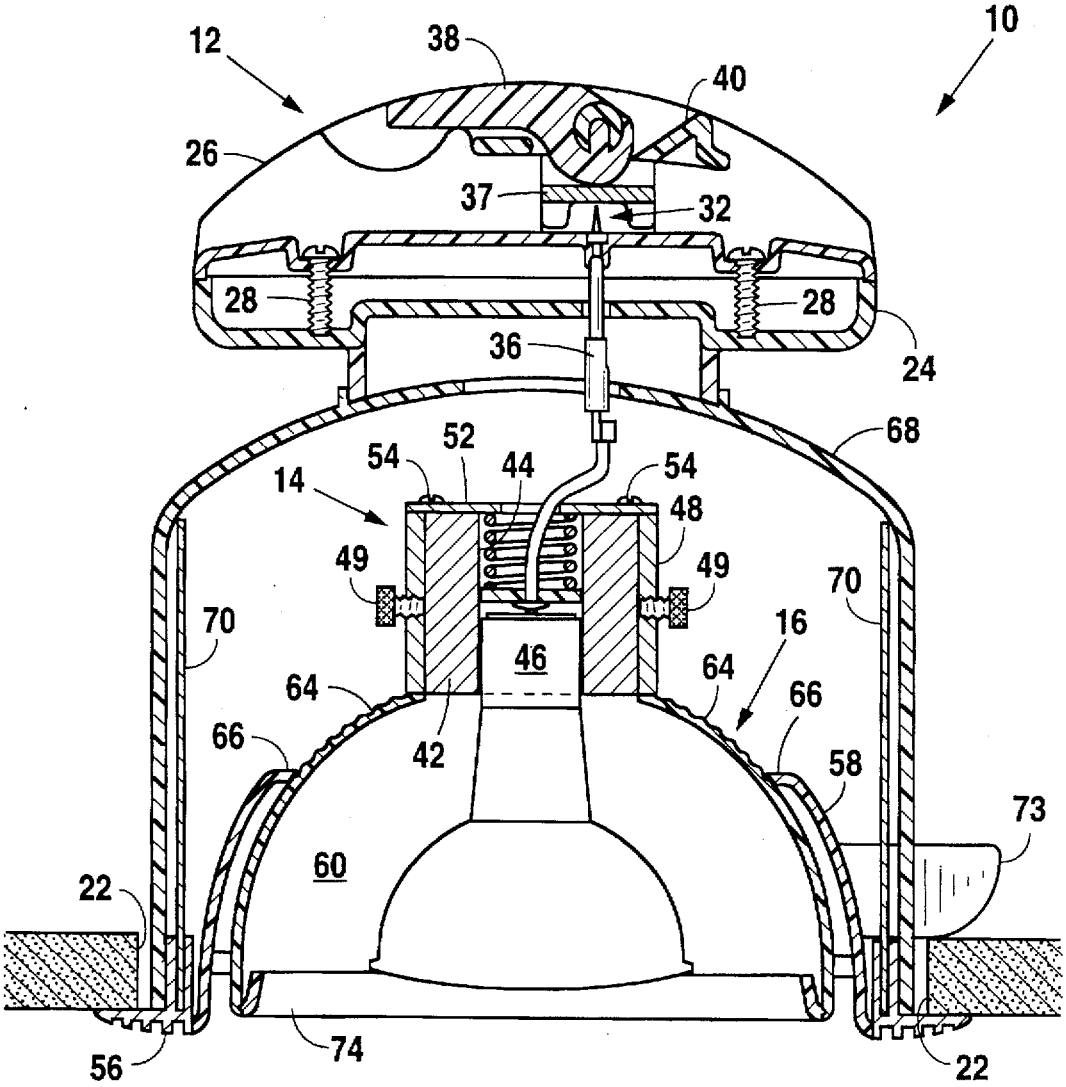
FIG. 16 is a cross-sectional view taken along the line 16—16 of FIG. 14.

In another embodiment of the light fixture 10 embodying the present invention, shown in FIGS. 14–16, the light fixture 10 includes a detachable cover 68 that surrounds the reflector module 16 and the heat sink module 14. The detachable cover 68 is spaced from the heat sink and reflector modules 14, 16 and provides a heat sealing enclosure around the heat sink and reflector modules 14, 16. Importantly, a basket sleeve 70, formed of heat conducting material such as aluminum, is disposed circumferentially around the reflector and heat sink modules 16, 14 at a position between the modules and the cover 68. In the illustrated embodiment, the basket sleeve 70 comprises a plurality of spaced apart fingers having ends that are adjacent the upper end of the heat sink module 14. Desirably, the interior surface of the detachable cover 68 is also coated with a heat reflective material such as aluminum to reflect heat from the cover inwardly to the heat conducting basket sleeve 70. Thus, heat generated by a bulb disposed in the reflector 60, and heat emanating from the bulb socket 46, is transferred through the heat sink 42 and rises by convection to the fingers of the sleeve 70. The sleeve 70 is mounted in grooves formed on the inner side of the trim ring 56 which, in this embodiment, is formed of a heat conducting material such as aluminum or steel. Thus, heat is transferred by conduction from the sleeve 70 to the heat conducting trim ring 56 and dissipated into the surrounding environment. Alternatively, the trim ring 56 may be formed of a plastic material having good heat transfer properties or may comprise a metal ring seated in the trim ring 56. It should also be noted, that in this embodiment, the piercing module 12 is detachably mounted directly on top of the detachable cover 68.

The embodiment of the light fixture shown in FIGS. 14–16 in which a detachable cover encloses the heat-generating components of the fixture 10, is particularly desirable in insulated ceiling installations and other installations in which combustible material may come into contact with, or into close proximity with, the lighting fixture 10. In this embodiment, the fixture 10 is retained in the opening 22 by a plurality of outwardly extending tabs 73 that are integrally formed with the reflector support member 58. The tabs 73 are formed so that, in their free state, they extend radially outwardly from the outer surface of the reflector support member 58. The heat conducting sleeve 70 and outer cover 68 are provided with slots through which the tabs 73 extend. Prior to installation through the opening 22, the tabs 73 are compressed radially inwardly and held until they clear the opening 22. Upon release, the tabs 73 spring outwardly until their bottom tapered edge contacts the side of the opening 22 and thereby retains the fixture 10 in the opening 22.

In other arrangements, such as dropped ceilings and other installations where there is no surrounding combustible material, the heat sink 42 may be directly exposed to the surrounding environment as described above. In still other embodiments, the housing 48 surrounding the heat sink 42 may have a plurality of slots 72, as shown in FIGS. 1–5 and 17, that extend through the housing 48 at regularly spaced radial positions above the heat sink 42. In the latter arrangement, heated air will rise through the heat sink 42 and then be discharged through the slots 72 to the surrounding environment.

In certain lighting applications, such as fluorescent and other non-incandescent systems, a ballast or other electronic circuit may be required for operation of the bulb. In such applications, an intermediate module, not shown, containing the required ballast or circuitry, may be conveniently inserted between the piercing module 12 and the heat sink module 14. Desirably, the intermediate module is detachably connected, such as by snap engagement of the respective housings. Alternatively, a conventional "smart module" containing a receiver and appropriate control circuits for remote operation of the light fixture, may be enclosed in an intermediate housing detachably positioned between the piercing module 12 and the heat sink module 12 either in addition to the ballast and specific system circuitry, or by itself. The "smart module" would permit operation of the light fixture by a remote hand held or wall-mounted transmitter.

Figure 17:
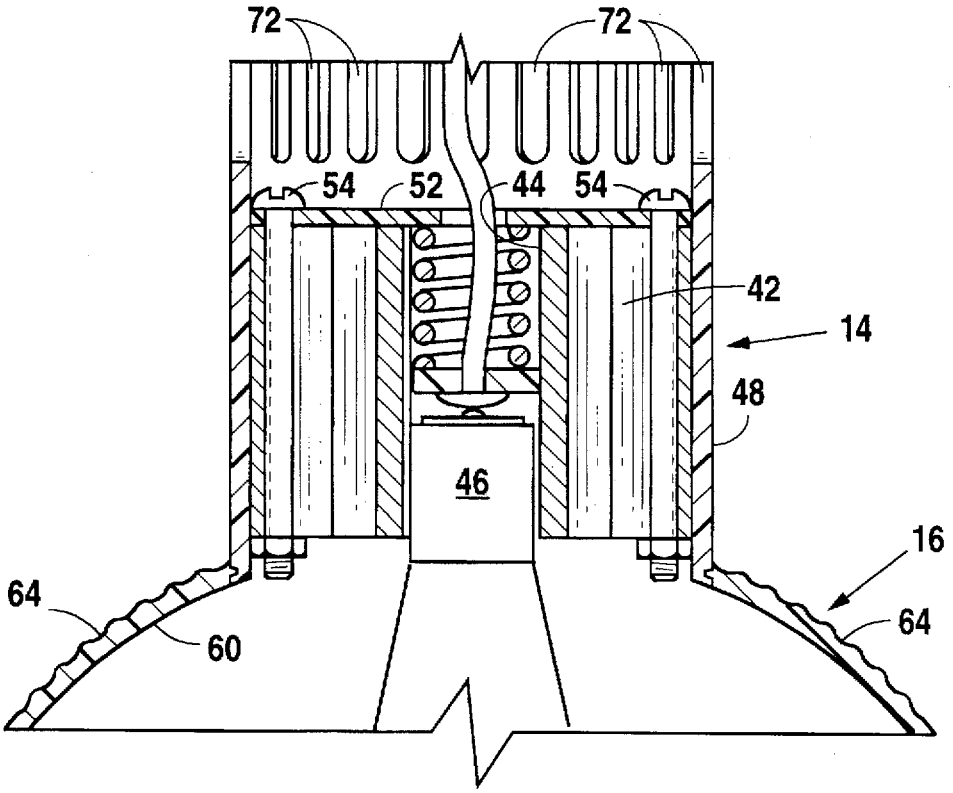
FIG. 17 is a sectional view of a portion of one arrangement of the reflector and heat sink modules of the lighting fixture embodying the present invention.

If desired, a detachable holder 74 may be mounted, either by friction engagement, clips, or snap engagement interference fit as shown in FIGS. 16 and 17, to the bottom of the reflector 60. The holder 74 may conveniently support a color filter, louver, lens, or other light conditioning or modifying element.

Figure 20:
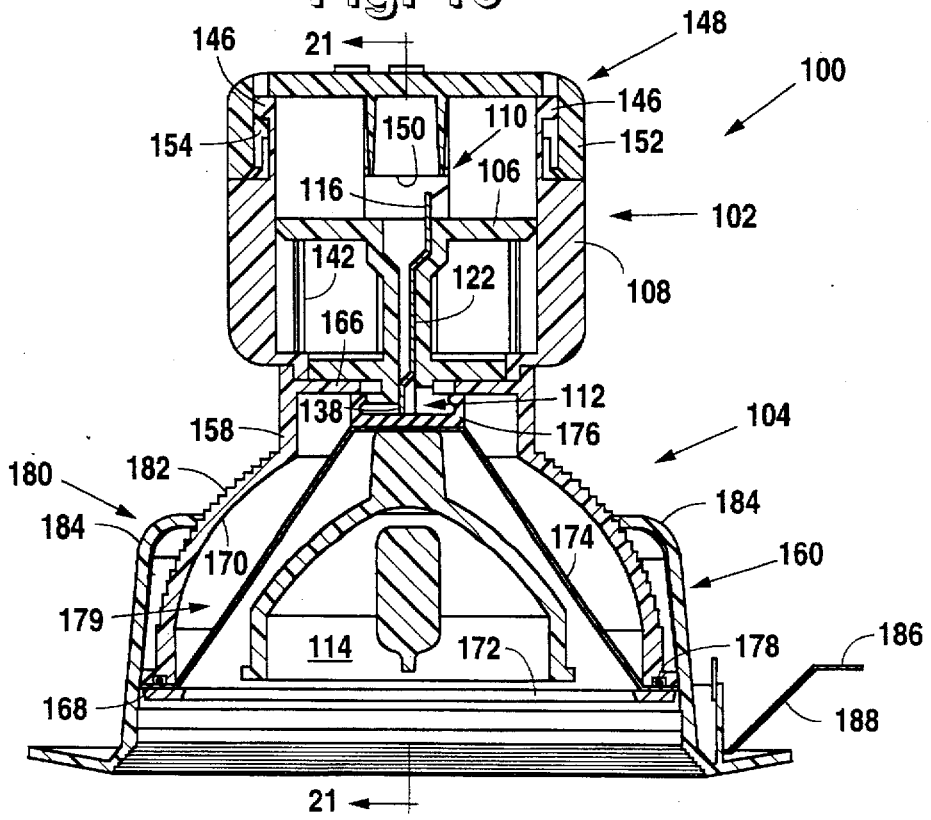
FIG. 20 is a cross-sectional view of the alternative embodiment of the lighting fixture, taken along the line 20—20 of FIG. 19.
Figure 21:
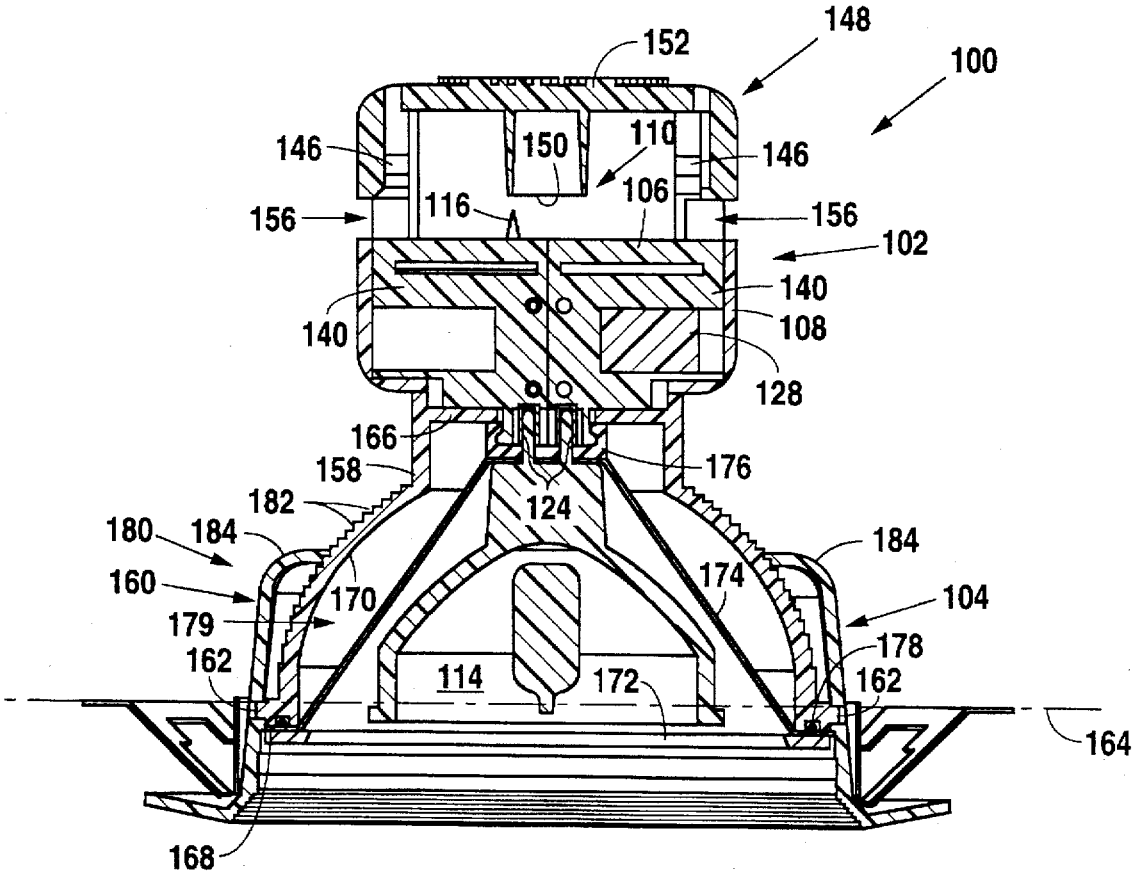
FIG. 21 is a cross-sectional view of the alternative embodiment of the lighting fixture, taken along the line 21—21 of FIG. 20.
Figure 22:
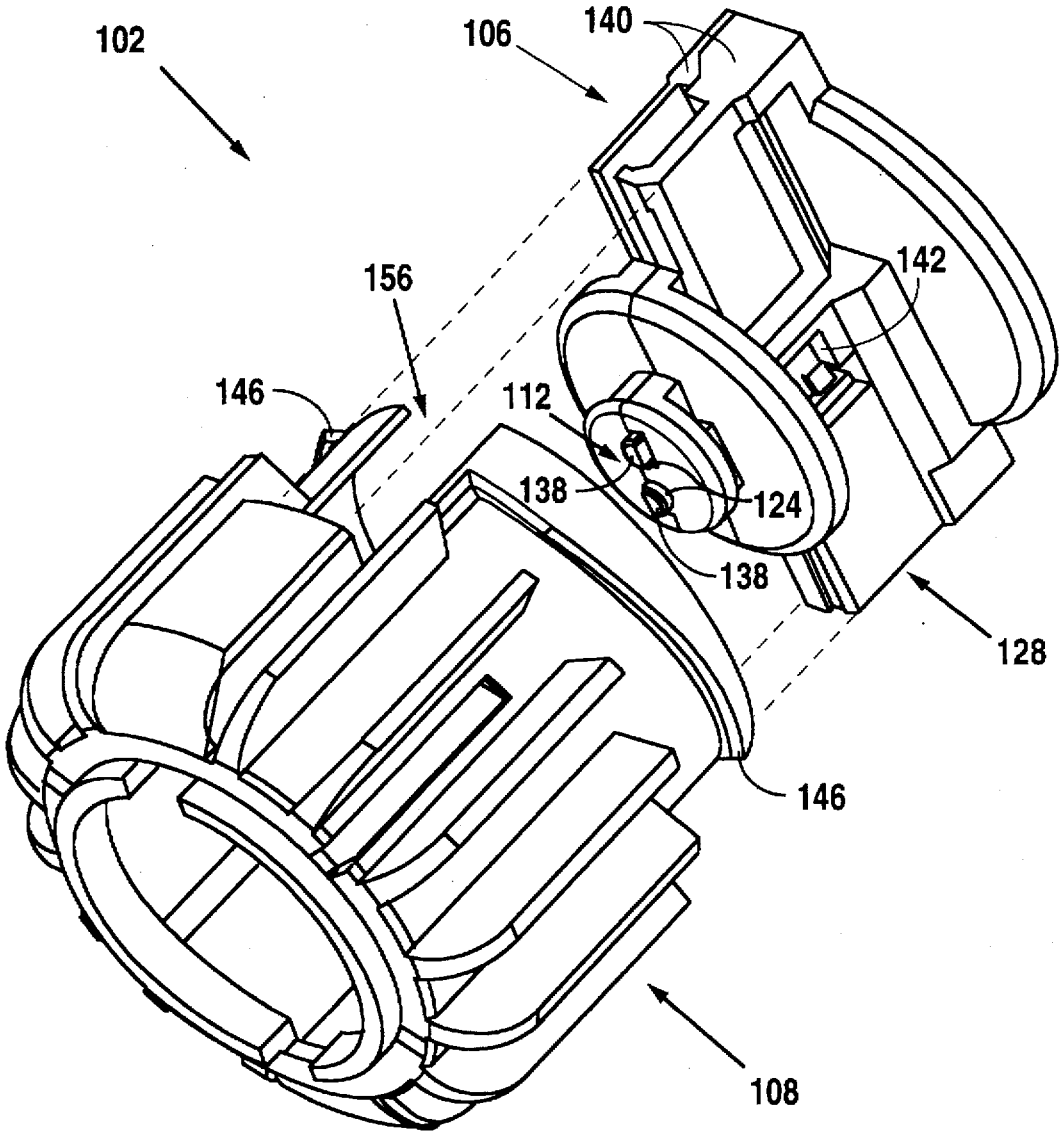
FIG. 22 is an exploded three-dimensional view of portions of the electrical power module of the alternative embodiment of the lighting fixture embodying the present invention.

Another alternative embodiment of the present invention is illustrated in FIGS. 19–24. In this later arrangement, a modular lighting fixture 100, has an integrated electrical power module 102 and a lamp shield module 104. The electrical power module 102 has a circuit member mounting body 106 that is disposed within a housing 108, as best shown in FIG. 22. The power module 102 further includes a first means 110 for piercing the insulation of two wires of a continuous electrical cable when the cable is inserted through the lighting fixture 100 and a second means 112 for receiving an electric lamp 114 and maintaining the lamp 114 in a fixed position with respect to the power module 102. In the preferred arrangement of the alternate embodiment, the first means 110 for piercing the insulation of two wires of a continuous insulated cable comprises a pair of spaced apart piercing pins 116 having sharply pointed tips at their respective ends.

Figure 23:
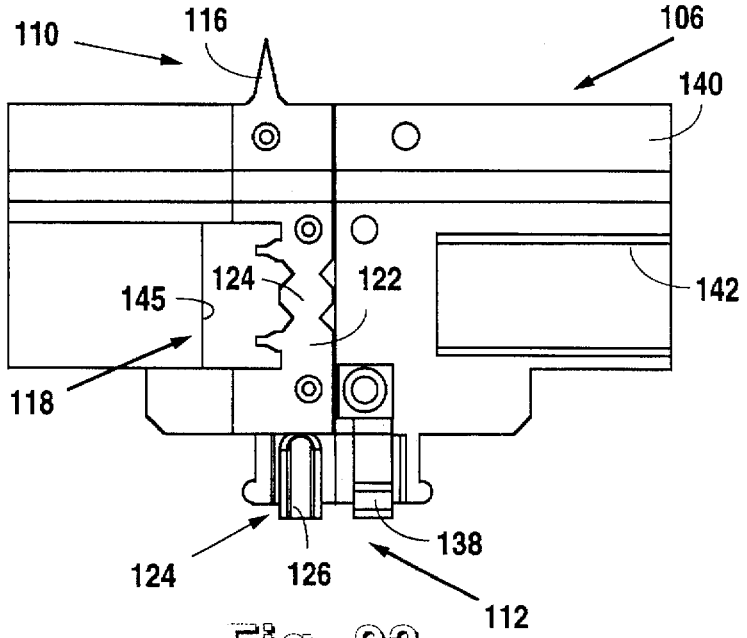
FIG. 23 is a plan view of one of a pair of mating circuit member mounting bodies of the lighting fixture embodying the present invention.
Figure 24:
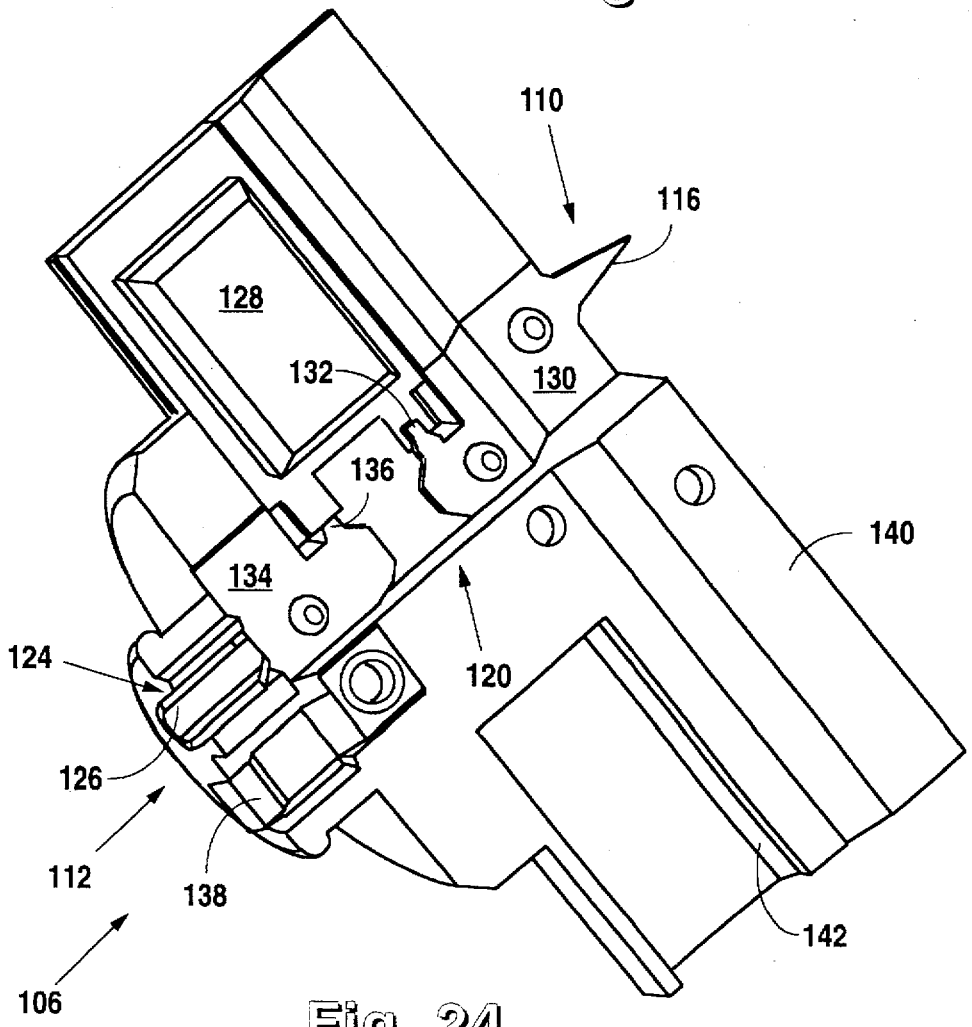
FIG. 24 is a three-dimensional view of one of the mating halves of the circuit member mounting body of the lighting fixture embodying the present invention, showing a thermal cutout member interposed between two components of an electrical circuit.

The electrical power module 102 further includes separate first and second electrical circuits 118, 120, as best seen in FIGS. 23 and 24, that extend between the first means 110 for piercing the wires and the second means 112 for retaining the lamp. The first and second electrical circuits 118, 120 provide respective separate electrical communication between the first means 110 and the second means 112. In the preferred embodiment of the alternative lighting fixture 100, the first electrical circuit comprises an elongated strip 122 that is desirably formed by stamping the strip 122 from a sheet of electrically conductive material, such as beryllium copper.

One of the pair of pins 116 is integrally formed on a first end of the strip 122, and an open ended cylindrical socket 124, representing a portion of the second means 112 for receiving an electric lamp 114 and maintaining the lamp 114 in a fixed position with respect to the power module 102, is integrally formed on a second end of the strip 122. The socket 124 may be viewed as having a semi-cylindrical shape or alternatively described as having a full cylindrical shape with a longitudinal slot extending along one side of the cylinder. In either characterization, the socket 124 has a bore 126 that is adapted to engage a pin of the lamp 114 when the lamp 114 is inserted in the fixture 100. In the illustrated arrangement, the lamp 114 comprises a 12 volt type MR16 halogen lamp. Other socket arrangements for the power module 102 that are adapted for other lamps, such as non-halogen incandescent bulbs and fluorescent lamps, may be interchanged for the socket arrangement described above.

The second electrical circuit 120 includes a thermal cutout member 128, such as a KLIXON® switch produced by Texas Instruments, which opens in response to sensing a temperature above a predetermined value. As best shown in FIG. 24, the thermal cutout member 128 is interposed between a first electrically conductive member 130 that has another one of the pair of piercing pins 116 integrally formed on a first end, and a tab 132 integrally formed on a second end. The tab 132 is adapted to mate with one of the contacts of the thermal cutout 128. The second electrical circuit 120 also includes a second electrically conductive member 134 that has another one of pairs of the sockets 124 integrally formed on a first end of the second member 134 and a tab 136 integrally formed on a second end that is adapted to mate with the another contact of the thermal cutout member 128.

The second means 112 for receiving an electrical lamp and maintaining the lamp in a fixed position with respect to the power module also includes a pair of springs 138, preferably formed of spring steel, which are fixedly mounted in cantilevered fashion in the circuit member mounting body 106. Each of the springs 138 are disposed in respective alignment with the open side of one of the sockets 124 at a position where the spring provides a bias force against an external surface of a respective pin of the lamp 114 when the pin base of the lamp 114 is inserted into the socket 124.

Advantageously, the circuit member mounting body 106 of the power module 102 is formed by joining two mating halves 140, which are mirror images of each other, together to form a single structure. The mating halves 140 are desirably formed of a high temperature, injection moldable, electrically nonconductive thermoplastic material, such as a polyetherimide resin, with the respective components of the first and second electrical circuits 118, 120 heat staked to a respective one of the halves 140 before joining the two halves together. Thus, each of the two mating halves 140, after molding and subassembly have a continuous elongated strip 122 secured to the plastic body as shown in FIG. 23.

Desirably, prior to joining the mating halves 140, the thermal cutout member 128 is inserted into a cavity 142 formed in the mating halves 140, with each of the contacts of the thermal cutout member 128 bearing against a respective one of the tabs 132, 136. The mating halves 140 may then joined by ultrasonic welding, adhesives, or other assembly technique of choice, to form the circuit member mounting body 106.

After joining the two mating halves 140 together, with the thermal cutout member 128 internally positioned within the circuit member mounting body 106, a center portion 144 of the elongated strip disposed in contact with the thermal cutout member 128 is removed by inserting a punch through a window 145, provided in the mating half structure 140, and severing the center portion 144 from the elongated strip. After removal of the center section 144, the separate first and second electrically conductive members 130, 134 of the second electrical circuit 120 are thus formed with each member 130, 134 being rigidly embedded within the mounting body 106. Also, the thermal cutout member 128 is advantageously positioned within the mounting body 106 in fixed relationship with respect to the electrically conductive tabs 132, 136 of the conductive members 130, 134. Importantly, the internally disposed components of the first and second electrically conductive circuits 118, 120 provide the structural strength for support of the piercing pins 116, the sockets 124, and the springs 138.

Thus, the first electrical circuit 118 provides an electrically conductive path from a first one of the piercing pins 116, through the continuously elongated strip 122, to a first one of the sockets 124, all of which are formed as a single, unitary structure. The second electrical circuit 120, which is interruptible, or capable of being opened, if a predetermined operating temperature is exceeded, comprises an electrically conductive path from a second one of the pins 116, through the first electrically conductive member 130, to the tab 132, thence through the thermal cutoff member 128 to the tab 136 of the second electrically conductive member 134, and through the second electrically conductive member 134 to the second one of the sockets 124. This arrangement provides important advantages when the fixture is arranged for use with high temperature lamps such as halogen lamps. However, the thermal cutout member 138 may not be required for other lighting applications such as non-halogen incandescent bulb and fluorescent lamp arrangements. If not required, both the first and second electrical circuits 118, 120, may be formed as single, one-piece elongated strips 122, as described above with respect to the first electrically conductive member 118.

After formation of the circuit member mounting body 106, as described above, the mounting body 106 is inserted into the power module housing 108 which, preferably, is formed of the same high temperature, electrically nonconductive thermoplastic material as the body 106. After insertion in the housing 108, as indicated by dashed lines in FIG. 22, the mounting body 106 may be secured in fixed position with respect to the housing 108 by mechanical devices such as cooperating tabs and grooves, screws, pins or, preferably by ultrasonically welding selected mutually abutting surfaces of the two members whereby the circuit member mounting body 106 and the housing 108 form a single, unitary structure with two separate electrical circuits, one of which may contain a thermal cutout switch, embedded within the single structure.

The lighting fixture 100 further includes a movable pressure member adapted to biasedly contact a portion of a cable extending through the power module 102 and a means 148 for forcibly moving the pressure member in a direction toward the pins 116. In the illustrated alternative preferred embodiment of the present invention, a movable pressure member is provided by an annular ring 150 formed at a distal end of a cylinder extending downwardly from a removable cap 152, as illustrated in cross section in FIGS. 20 and 21. The means 148 for forcibly moving the pressure member 150 in a direction toward the pins 116 is provided by the raised spiral surfaces 146, best seen in FIG. 22, which cooperate with an inwardly extending flange 154, viewable in FIG. 20, to draw the cap 152 downwardly against the power module 102 when the cap is rotated in a clockwise direction. As the cap 152 is rotated, an upper surface of the flanges 154 bears against a lower surface of the raised spiral ridges to draw the cap 152, and consequently the annular ring 150, into biased abutting contact with a cable, not shown, extending through laterally spaced openings 156 in the housing 108 of the power module 102. As the cap 152 lowers, the cable is forced against the pins 116 with sufficient force to pierce the insulation surrounding individual wires of the cable. When the cap 152 is fully seated, the annular ring 150 is maintained in biased abutting contact against the upper surface of the cable, assuring positive engagement of the pins 116 with respective wires in the cable.

The lamps shield module 104 has a first portion 158 that is attachable, by mechanical means or, preferably. by ultrasonic welding, to the electrical power module 102, and a second portion 160 that is rotatably mounted on the first portion 158, as described earlier with respect to an initial embodiment. In the present embodiment, as shown in FIG. 21, a pair of oppositely spaced support pins 162 are integrally formed with the first portion 158 of the lamp shield module 104 and snap into holes formed in the second portion 160. Thus, the first portion 158 is rotatably movable with respect to the second portion 104 about an axis 164 extending through the support pins 162 of the second portion 160.

The first portion 158 of the lamp shield module 104 is preferably also formed of the same high temperature, electrically nonconductive, injection moldable thermoplastic material as the circuit member mounting body 106, and has an upper annular wall 166 disposed adjacent to the power module 102 and a lower annular wall 168 formed at a lower open end of the lamp shield module 104. The first portion 158 of the lamp shield module also has an interior surface 170 that extends between the upper and lower annular walls 166, 168. If desired, a trim ring 172 may be mounted on the lower annular wall 168 of the first portion 158 of the lamp shield module 104. In certain applications, it may be desirable to prevent a flow of room air between the trim ring and the interior surface of the second portion 160 of the lamp shield module 104, i.e., from the room to a cavity on the opposite side of the ceiling or wall opening in which the fixture 100 is mounted. For those applications, the trim ring 172 may be formed of a resilient material, such as silicon rubber, and extend radially outwardly into abutment with the interior wall of the second portion 160 and form a flexible seal between the exterior wall of the first portion 158 and the interior wall of the second portion 160 of the lamp shield module 104.

In applications for use with high temperature bulbs, a dead air insulating space 179 is provided between the lamp 114 and an outer surface of the lamp shield module 104. In the alternative preferred embodiment, a truncated conically-shaped thermal radiant reflector 174, formed of aluminum or similar material having high heat reflectance properties, is disposed inwardly from the interior surface 170 of the first portion 158. An annular elastomeric gasket 176, e.g., formed of silicone rubber, is interposed between the thermal radiant reflector 174 and the upper annular wall 166 of the first portion 158. An annular O-ring 178 is interposed between the thermal radiant reflector 174 and a groove formed in the lower annular wall 168 of the first portion 158 of the lamp shield module 104. The interior surface 170 of the first portion 158 of the lamp shield module 104, the thermal radiant reflector 174, the annular elastomeric gasket 176, and the O-ring 178, cooperate to define a hermetically sealed chamber 179 between the lamp 114 and the outer surface of the first portion 158 of the lamp shield module 104. The air-tight, sealed chamber 179 advantageously prevents high thermal conductance between the lamp 114 and the outer surfaces of the lighting fixture 100.

The lamp shield module 104 further includes a means 180 for maintaining the first portion 158 of the lamp shield module 104 in a selected angular relationship with respect to the second portion 160 of the lamp shield module 104. As described above with reference to earlier described embodiments, the angular retaining means 180 is provided by a plurality of surface features, for example, ridges 182 defined on the outer surface of the first portion 158 of the lamp shield module 104, which are adapted to receive one or more detent members 184 that are integrally formed with the second portion 160 of the lamp shield module 104. As best shown in FIG. 21, a pair of equally spaced apart detent members 184 have an inwardly extending finger which is in biased contact with a respective one of the ridges 182 on the outer surface of the first portion 158. The detent members 184 forcibly engage respective ridges, as shown in FIG. 20. The detent members 184 are disposed at right angles with respect to the support pins 162, so that when the first portion 158 of the lamp shield module 104 is tilted, or rotated about the axis 164, the detente members 158 maintain the thus selected tilted relationship between the first portion 158 and the second portion 160 of the lamp shield module 104.

The lamp shield module 104 also includes a means 186 for retaining the lighting fixture 100 in a fixed relationship with respect to an opening in a predefined mounting surface, such as a ceiling, when the lighting fixture 100 is mounted in the opening. Preferably, as described above with respect to earlier embodiments, the light fixture retaining means 186 comprises a plurality of spring clips 188 that are mounted on the second portion 160 of the lamp shield module 104 and extend radially outwardly from the second portion 160 to engage a surface, such as a ceiling, surrounding an opening in which the lighting fixture 100 is installed.

Thus, it can be readily seen that the electric power module 102 and the lamp shield module 104 may be separately configured to form a variety combinations suitable for specific lighting and lamp applications. For example, in some applications, the second means 112 for receiving an electric lamp and maintaining the lamp in a fixed position with respect to the power module 102 may comprise a screw-threaded socket to receive an incandescent bulb, or have another configuration for a fluorescent bulb. In a similar manner, if it is desirable in certain applications to have a grounded fixture, a third pin 116 may be provided as a part of the piercing means 110. Likewise, in lower temperature applications, the thermal radiant reflector 174 that partially defines the dead air chamber 179 and/or the thermal cutout member 128, may not be required. It is also contemplated that a piercing means, as described above with respect to FIGS. 6–13 or other piercing means, may be substituted for the screw-down cap 152.

Thus, it can be seen that the lighting system 10 embodying the present invention, provides a versatile arrangement that can be readily adapted to low voltage, line voltage, a plurality of bulb types, or installation in either insulated or noninsulated ceilings. Advantageously, the lighting fixtures 10 embodying the present invention can be marketed as kits with common piercing modules 12 and reflector modules 16, and a heat sink module 14 specifically adapted to a specific lighting system. The commonality of modules between the various systems provides manufacturing economy and reduced parts inventory. If the lighting fixture 10 is to be installed in an insulated ceiling, or other installation requiring a low temperature outer surface for the fixture, the detachable cover 68 and heat conducting sleeve 70 may be added separately or provided in the kits containing the basic components of the fixture. Thus, the modular lighting fixture 10 embodying the present invention, provides an economical, easy-to-install fixture that may be sold as prepackaged modules, or as components of a kit, that are easily assembled at the job site and installed by professionals or do-it-yourselfers in new or pre-existing structures.

Although the present invention is described in terms of a preferred exemplary embodiment, with specific illustrative key constructions and arrangements, those skilled in the art will recognize that changes in those arrangements and constructions, and in the specifically identified materials, may be made without departing from the spirit of the invention. Such changes are intended to fall within the scope of the following claims. Other aspects, features, and advantages of the present invention may be obtained from a study of this disclosure and the drawings, along with the appended claims.

What is claimed is:

1. A lighting fixture, comprising:

a piercing module having a channel defined therein by walls having a length extending across said piercing module and shaped to mate with the outer surface of a predefined continuous insulated electrical cable and at least partially surround said cable in abutting contact therewith, and a means for piercing the insulation of said continuous insulated cable and providing electrical communication between said cable and said piercing means;

a heat sink module detachably connectable to said piercing module and having a heat sink with a central bore extending through the heat sink and a bulb-receiving socket detachably disposed within said bore of the heat sink, said socket being electrically connectable with said piercing means; and a reflector module having a trim ring, a reflector support member having a longitudinal axis perpendicular to a mounting surface of the fixture, and a reflector detachably connectable to said heat sink module, said reflector being rotatably mountable in said reflector support member for movement about an axis transverse to said longitudinal axis of the reflector support member, and said reflector support member includes a means for maintaining said reflector at a predetermined position with respect to said transverse axis.

2. A lighting fixture, as set forth in claim 1, wherein said means for piercing the insulation of said continuous insulated cable and providing electrical communication between said wire and said piercing means includes at least two pins each respectively disposed at a predetermined position in said channel of the piercing module in transverse alignment with a predefined wire of said cable, a moveable pressure plate adapted to mate with and at least partially surround a portion of said wire in tightly abutting contact therewith, and a means for forcibly moving said pressure plate in a direction toward said pins.

3. A lighting fixture, as set forth in claim 1, wherein said reflector has an outer surface and said means for maintaining said reflector at a predetermined position with respect to said transverse axis includes a plurality of surface features defined in the outer surface of the reflector, each of said surface features being adapted to receive a detent member, and a pair of detent members integrally formed with said reflector support member and biased toward said reflector wherein said detent members forcibly engage selected ones of the surface features defined on the outer surface of said reflector when said reflector is mounted in said reflector support member.

4. A lighting fixture, as set forth in claim 1, wherein said fixture includes means for retaining said fixture in a predefined opening.

5. A lighting fixture, as set forth in claim 1, wherein said fixture includes a cover surrounding said reflector module and said heat sink module in spaced heat sealing relationship with said modules.

6. A lighting fixture, as set forth in claim 5, wherein said fixture includes a sleeve formed of heat conductive material and disposed circumferentially around said reflector and heat sink modules at a position between said modules and said cover, said sleeve being in thermally conductive communication with said trim ring.

7. A lighting fixture, as set forth in claim 6, wherein the trim ring of said reflector module is at least partially formed of a metallic material.

8. A lighting fixture, as set forth in claim 7, wherein said cover has an interior surface coated with a heat-reflecting material.

9. A lighting fixture, as set forth in claim 6, wherein said sleeve is formed of a sheet material shaped to provide a plurality of spaced-apart fingers having ends adjacent said heat sink module.

10. A lighting fixture for mounting in an opening in a predefined surface, comprising:

an electrical power module having a first means for piercing the insulation of two wires of a continuous insulated cable, a second means for receiving an electric lamp and maintaining said lamp in a fixed position with respect to said power module, and separate first and second electrical circuits extending between said first means and said second means and providing respective separate electrical communication therebetween, wherein at least one of said first and second electrical circuits comprises an elongated strip formed of an electrically conductive metallic material having a portion of said first means integrally formed on a first end of the strip and a portion of said second means integrally formed on a second end of said strip; and a lamp shield module having a first portion attachable to said electrical power module in fixed relationship therewith, and a means for retaining the lighting fixture in fixed relationship with the opening in said predefined mounting surface when said lighting fixture is mounted in the opening.

11. A lighting fixture, as set forth in claim 10, wherein said lamp shield module includes a second portion rotatably mounted on said first portion, said first portion being moveable with respect to said second portion about an axis extending through the second portion.

12. A lighting fixture, as set forth in claim 10, wherein said first means for piercing the insulation of two wires of a continuous electrical cable comprises a pair of spaced apart pins, and said elongated strip has a first one of said pair of pins integrally formed on a first end of said strip.

13. A lighting system, as set forth in claim 12, wherein said second means for receiving an electrical lamp and maintaining said lamp in a fixed position with respect to said power module comprises a pair of open-ended cylindrical sockets each of which have a bore adapted to engage a pin of an electrical lamp when the lamp is inserted in said socket and a longitudinal slot extending along one side of the respective cylindrical socket, and said elongated strip has a first one of said pair of sockets integrally formed on a second end of said strip.

14. A lighting fixture, as set forth in claim 10, wherein at least one of said first and second electrical circuits includes a thermal cutout member that opens the respective electrical circuit in response to exposure to a temperature above a predetermined value.

15. A lighting system, as set forth in claim 14, wherein said first electrical circuit comprises said elongated strip and said second electrical circuit comprises a first electrically conductive member having opposed ends defined at a first end by one of said pair of spaced apart pins integrally formed with said electrically conductive member, and at a second end by a tab adapted for electrical connection with a first terminal of said thermal cutout member, said tab being integrally formed with said electrically conductive member.

16. A lighting system, as set forth in claim 15, wherein said second electrical circuit comprises a second electrically conductive member having opposed ends and said second means for receiving an electrical lamp and maintaining said lamp in a fixed position with respect to said power module comprises a pair of open-ended cylindrical sockets each of which have a bore adapted to engage a pin of an electrical lamp when the lamp is inserted in said socket and a longitudinal slot extending along one side of the respective cylindrical socket, said second electrically conductive member having one of said pair of sockets integrally formed on a first end of said second member and a tab, integrally formed on a second end of the member, adapted for electrical connection with a second terminal of said thermal cutout member.

17. A lighting system, as set forth in claim 10, wherein said second means for receiving an electrical lamp and maintaining said lamp in a fixed position with respect to said power module comprises a pair of open-ended cylindrical sockets each having a bore adapted to receive a respective pin of an electrical lamp when said pin is inserted in said socket, a longitudinal slot extending along one side of each of the cylindrical sockets, and a pair of cantilevered springs each fixedly mounted on said power module in respective alignment with the longitudinal slot of one of said sockets at a position sufficient to provide a bias force against an external surface of the respective pin of the electrical lamp when said pin is inserted in the socket.

18. A lighting fixture, as set forth in claim 10, wherein said first means for piercing the insulation of two wires of a continuous insulated cable includes two pins each respectively disposed at a position aligned with a respective one of the wires of said cable when the cable is inserted through said lighting fixture, a moveable pressure member adapted to contact with a portion of said cable in biased abutting contact therewith, and a means for forcibly moving said pressure plate in a direction toward said pins.

19. A lighting fixture, as set forth in claim 10, wherein said lamp shield module includes a second portion rotatably mounted on said first portion, said first portion being moveable with respect to said second portion about an axis extending through the second portion, and a means for maintaining the first portion of said lamp shield module in a selected angular relationship with respect to a second portion of the lamp shield module.

20. A lighting fixture, as set forth in claim 19, wherein first portion of the lamp shield module has a defined outer surface, and said means for maintaining the first portion of said lamp shield module in a selected angular relationship with respect to said second portion of the lamp shield module includes a plurality of surface features, defined on said outer surface of the first portion, that are adapted to receive a detente member, and said second portion of said lamp shield module includes a pair of equally spaced apart detente members integrally formed with said second portion and biased toward said first portion of the lamp shield module wherein said detente members forcibly engage selected ones of the surface features defined on the outer surface of said first portion of the lamp shield module.

21. A lighting fixture, as set forth in claim 10, wherein the first portion of said lamp shield module includes:

an upper annular wall disposed adjacent to the power module;

a lower annular wall spaced from said upper annular wall;

an interior surface extending between said upper and lower annular walls;

a thermal radiant reflector spaced inwardly from said interior surface;

an annular elastomeric gasket interposed between said thermal radiant reflector and said upper annular wall; and an annular O-ring interposed between said thermal radiant reflector and said lower annular wall, wherein said interior surface of the first portion of the lamp shield module, said thermal radiant reflector, said annular elastomeric gasket, and said O-ring cooperate to define a hermetically sealed chamber between a lamp when installed in said lighting fixture and an external surface of the fixture.

22. A lighting fixture, as set forth in claim 10, wherein said means for maintaining said second portion of the lamp shield module in fixed relationship with said opening in said predefined mounting surface when said lighting fixture is mounted in the opening includes a plurality of spring clips extending radially outwardly from said second portion of the lamp shield module.

* * * * *